US007152253B2

(12) United States Patent
Abelman et al.

(10) Patent No.: US 7,152,253 B2
(45) Date of Patent: Dec. 26, 2006

(54) CHINSTRAP AND CHIN CUP FOR A PROTECTIVE HEADGEAR

(75) Inventors: Michael Abelman, Sebastian, FL (US); Dominick Cabal, Melbourne, FL (US)

(73) Assignee: Macho Products, Inc., Sebastian, FL (US)

( * ) Notice: Subject to any disclaimer, the term of this patent is extended or adjusted under 35 U.S.C. 154(b) by 45 days.

(21) Appl. No.: 10/996,267

(22) Filed: Nov. 23, 2004

(65) Prior Publication Data

US 2006/0117466 A1 Jun. 8, 2006

(51) Int. Cl.
*A42B 7/00* (2006.01)

(52) U.S. Cl. ..... 2/421; 2/909

(58) Field of Classification Search ..... 2/421, 2/425, 417, 418, 419, 423, 908, 909, 9
See application file for complete search history.

(56) References Cited

U.S. PATENT DOCUMENTS

| | | | | | |
|---|---|---|---|---|---|
| 863,315 | A | * | 8/1907 | Pierce | 2/243 |
| 1,714,275 | A | * | 5/1929 | Mullins | 2/425 |
| 1,716,550 | A | * | 6/1929 | Hart | 2/9 |
| 1,759,738 | A | * | 5/1930 | Erario | 2/9 |
| 2,867,811 | A | | 1/1959 | Jones | |
| 2,890,457 | A | | 6/1959 | Marietta | |
| 2,907,750 | A | * | 9/1959 | McMurry | 2/415 |
| 3,113,318 | A | | 12/1963 | Marietta | |
| 3,242,500 | A | | 3/1966 | Deer | |
| 3,469,268 | A | * | 9/1969 | Phillips | 602/19 |
| 3,557,384 | A | * | 1/1971 | Barren et al. | 2/2.5 |
| 3,616,463 | A | | 11/1971 | Theodore et al. | |
| 3,619,813 | A | * | 11/1971 | Marchello | 2/421 |
| 3,787,895 | A | | 1/1974 | Belvedere | |
| 3,916,446 | A | * | 11/1975 | Gooding | 2/421 |
| 3,943,572 | A | * | 3/1976 | Aileo | 2/415 |
| 4,038,700 | A | | 8/1977 | Gyory | |
| 4,134,155 | A | | 1/1979 | Robertson | |
| 4,222,122 | A | * | 9/1980 | Toms | 2/9 |
| 4,477,929 | A | * | 10/1984 | Mattsson | 2/425 |
| 4,651,356 | A | * | 3/1987 | Zide | 2/421 |
| 4,706,305 | A | | 11/1987 | Cho | |
| 4,741,054 | A | * | 5/1988 | Mattes | 2/421 |
| 4,884,301 | A | * | 12/1989 | Aileo | 2/421 |
| 5,177,815 | A | | 1/1993 | Andujar | |
| 5,351,342 | A | | 10/1994 | Garneau | |
| 5,361,416 | A | | 11/1994 | Petrie et al. | |
| 5,676,426 | A | * | 10/1997 | Herring | 297/484 |
| 5,685,020 | A | * | 11/1997 | Powell et al. | 2/421 |

(Continued)

FOREIGN PATENT DOCUMENTS

| | | | |
|---|---|---|---|
| WO | WO 8501665 | A1 * | 4/1985 |

*Primary Examiner*—Rodney M. Lindsey
(74) *Attorney, Agent, or Firm*—Robert L. Wolter, Esquire; Beusse Wolter Sanks Mora & Maire, P.A.

(57) ABSTRACT

A chinstrap with a chin cup for a protective headgear that has a first side panel covering at least a portion of one side of the head of a user and a second side panel covering at least a portion of the opposite side of the head. The chinstrap includes a first free end attachment to the chin cup and extends laterally therefrom from cup and a second free end attached to the chin cup extending laterally therefrom opposite the first free end. A hook/loop fastening system is attached to the free ends of the chinstrap and chin cup whereby the free ends operatively engage the headgear and are releasable secured to the chin cup.

12 Claims, 3 Drawing Sheets

U.S. PATENT DOCUMENTS 5,685,021 A * 11/1997 Tsujino ..... 2/425
5,713,082 A 2/1998 Bassette et al.
5,915,538 A * 6/1999 Basson et al. ..... 2/421
5,946,735 A 9/1999 Bayes
5,950,244 A 9/1999 Fournier et al.
6,159,324 A 12/2000 Watters et al.
6,272,692 B1 8/2001 Abraham
6,289,522 B1 9/2001 Jones et al.
6,389,607 B1 5/2002 Wood
6,427,253 B1 8/2002 Penny

* cited by examiner

CHINSTRAP AND CHIN CUP FOR A PROTECTIVE HEADGEAR

FIELD OF THE INVENTION

This invention pertains to protective headgear for sporting activities such as in boxing, martial arts and self-defense training. More specifically, this invention pertains to mechanisms, such as chinstraps, for securing the headgear on the head.

BACKGROUND OF THE INVENTION

Participants in contact sports, or self-defense training often require protective wear to prevent or minimize injury. Helmets or protective headgear are used in various sports such as football, baseball, ice hockey, field hockey, martial arts, boxing or self-defense training. Protective headgear used in boxing and martial arts may be fabricated from a resilient foam material such as polyvinylnitrile foam, which is cut and/or molded to cover sensitive portions of the head for protection. Sections of the headgear may be perforated, or contain openings for ventilation, viewing or hearing. The foam absorbs energy from blows to the head, and is lightweight to minimize stress to the neck and shoulders during use.

Examples of padded headgear used in boxing, martial arts training or self-defense training are illustrated in FIGS. 1 through 4. With respect to FIG. 1, the headgear 10 is retained on the head of a user by a chinstrap 11 that extends from one side of the headgear 10 to an opposite side. The chinstrap 11 is permanently affixed to a first side 12 and has a free end 13 that is attached to the second side 14 of the headgear 10 using known releasable fastening systems such as Velcro®. Although such a chinstrap works for purposes of retaining the headgear on the head, the headgear does not include a chin cup; therefore, the chin may be exposed to direct trauma.

The headgear 10 illustrated in FIGS. 2 and 3 includes a panel 15 that covers the chin for protection. The panel 15 is integrally formed and connected with the sides 16 and 17 of the headgear. A back panel 18 can be flexed to fit the headgear 10 onto the head of the user. An adjustable strap 19 tightens the back panel 18 against the head to secure the headgear 10. In as much as the chin panel 15 is integrally connected to the sides 16, the chin pad is not adjustable, and the headgear may tend to loosely fit around the chin.

Another headgear 10 is shown in FIG. 4 includes a chinstrap 11 laced through holes 12A and 14A on the sides 12 and 14 of the headgear. The chinstrap 11 includes Velcro® fasteners on free ends 11A and 11B of the strap 11, such that free ends 11A and 11B of the chinstrap 11 are laced through the apertures on the respective sides 12A and 14A of the headgear and detachably secured to the chinstrap 11 at or near the jaw or chin of a user.

However, headgear fabricated from foam materials as described above that are encased within a vinyl coating may have a tendency to slip when a user sweats. Such headgear may not pass certain testing standards adopted by the American Standards for Testing and Materials for martial arts headgear.

SUMMARY OF THE INVENTION

The present invention is for a chinstrap and chin cup for a protective headgear which headgear has a first side panel that covers at least a portion of one side of the head of a user and a second side panel that covers at least a portion of an opposite side of the head and each side panel has an aperture. A chin cup having an indentation for receiving and engaging a chin of a user is attached to a chinstrap.

The chinstrap has a first free end operatively connected to the chin cup and extending laterally from the chin cup, and a second free end operatively connected to the chin cup and extending laterally from the chin cup opposite the first free end. Each of the first free end and second free end is capable of being inserted through an aperture on a respective side panel of the headgear. A fastening system is operatively connected to the chinstrap, for detachably securing the first free end and the second free end to a bottom of the chin cup after being inserted through the apertures on the headgear.

In a preferred embodiment, the fastening system includes one or more hook and/loop fastening components. A hook component is affixed to a bottom surface of the chin cup; a first loop component is affixed to the first free end of the chinstrap; and, a second loop component is affixed to the second free end of the chinstrap. The free ends of the chinstrap are inserted through apertures on respective side panels of the headgear and detachably secured to the bottom surface of the chin cup.

BRIEF DESCRIPTION OF THE DRAWINGS

The features and advantage of the present invention will become apparent from the following detailed description of the invention when read with the accompanying drawings.

DETAILED DESCRIPTION OF THE DRAWINGS

Figure 1:
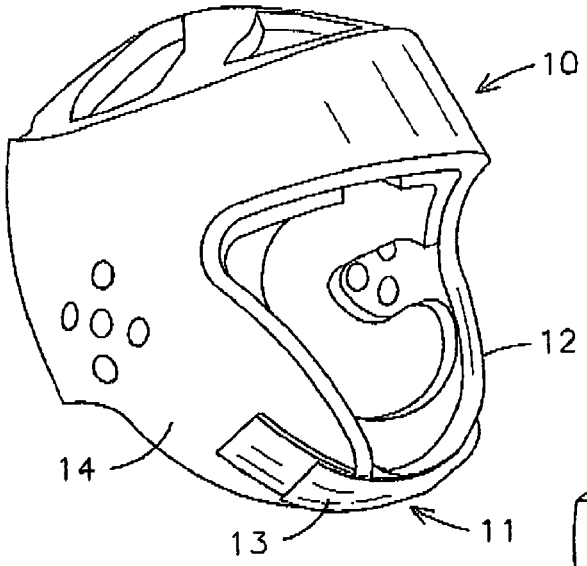
FIG. 1 PRIOR ART
FIG. 1 is a perspective view of prior art headgear.
Figure 2:
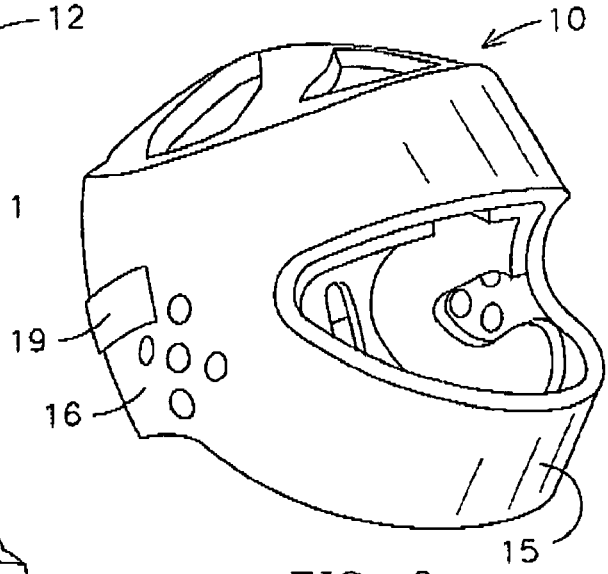
FIG. 2 PRIOR ART
FIG. 2 is a front perspective view of prior art headgear
Figure 3:
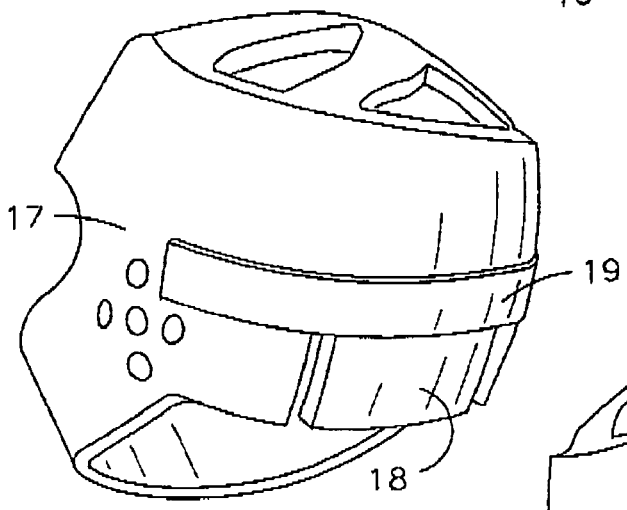
FIG. 3 PRIOR ART
FIG. 3 is a rear perspective view of the headgear in FIG. 2.
Figure 4:
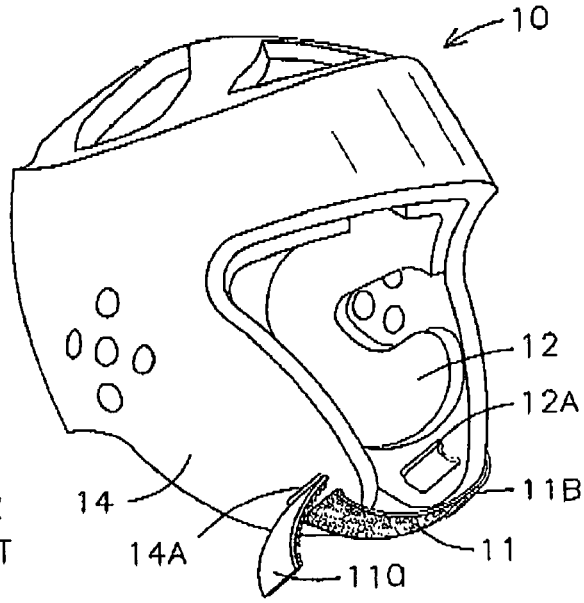
FIG. 4 PRIOR ART
FIG. 4 is a perspective view of prior art headgear.
Figure 5:
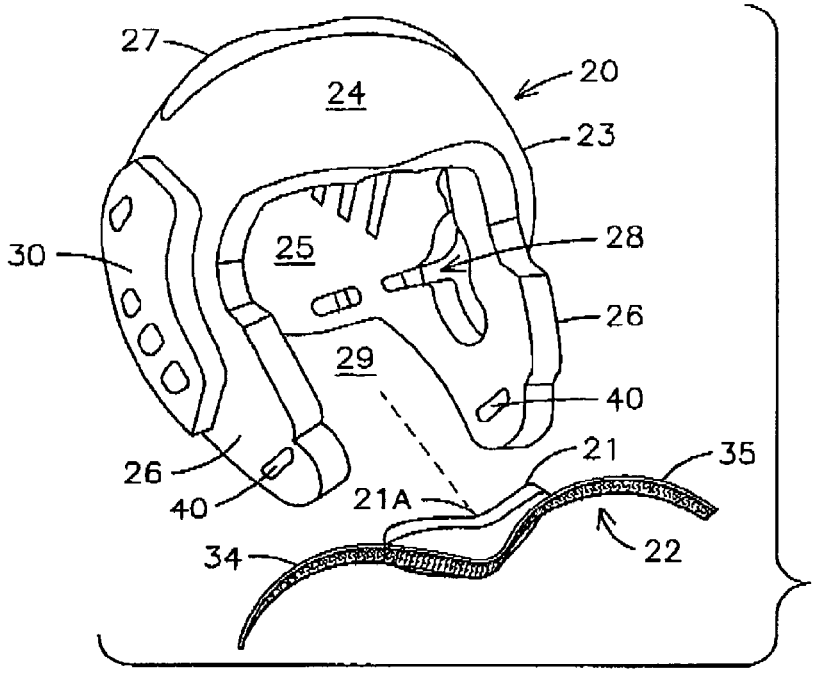
FIG. 5 is a perspective view of a headgear and chinstrap with a chin cup.
Figure 6:
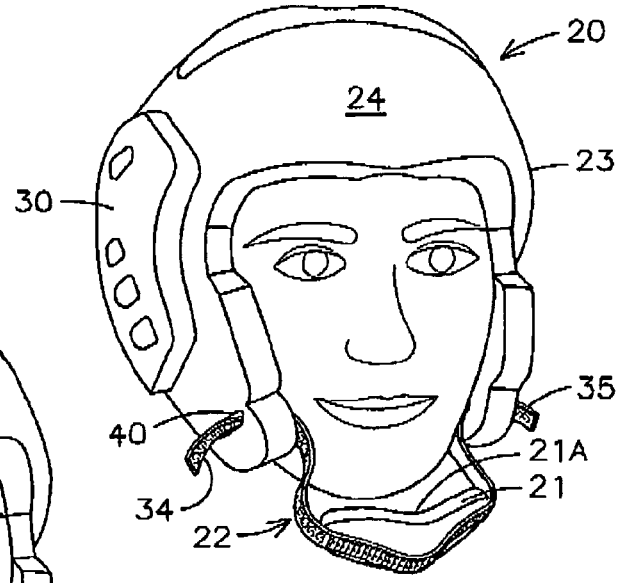
FIG. 6 is a front perspective view of the chinstrap prepared to secure the chin cup to the headgear.
Figure 7:
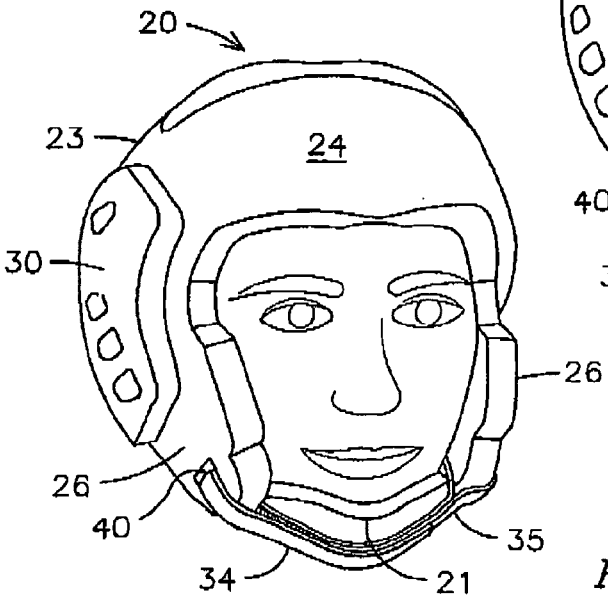
FIG. 7 is a front perspective view of the chin cup secured to the headgear and chin of a user.

An exemplary embodiment of the invention is illustrated in FIGS. 5 through 7 showing a headgear 20 with a chinstrap 22 having a chin cup 21. The chin cup 21 and chinstrap 22 are preferably used with a headgear that is constructed from a suitable foam material that is conformable and resilient, and is capable of absorbing energy and forces when contacted and deformed by a blow to the head of a user. For example, the foam material may be composed of polyvinylnitrile closed cell foam product that is die-cut according to predetermined specifications. The chinstrap 22 and chin cup 21 could also be used with other type helmets such as biking, football or lacrosse helmet having a hard plastic outer shell.

The headgear 20 preferably includes a circumferential member 23, or outer shell, that generally conforms to the shape of one's head and covers portions of one's head for protection. The circumferential member 23 includes a front selection 24 that covers the forehead, a back section 25 that covers the back of the head, two side sections 26 that cover the ears, temples, sides of the jaw and side of the head and a top section 27 that covers at least a portion of the top of the head. The sections 24, 25, 26 and 27 are arranged to form a first opening 28 through which a user is capable of viewing, and a second opening 29 through which a user's neck extends. Pads 30 may be attached to the circumferential member 23 to supplemental the protection of the member 23. All foam materials are encased within a reasonably tough pliable paint coating, preferably comprising a polyvinyl chloride. Known dipping or painting processes are used to apply the coating.

With respect to FIGS. 5 through 7 a chinstrap 22 is shown in connection with the headgear 20. The chinstrap 22 includes a chin cup 21 that receives and engages the chin of a user. The chinstrap 22 has two free ends 34 and 35 that extend laterally with respect to the chin cup 21. The chinstrap 22 and chin cup 21 may be formed as a flexible integral member, whereby the chin cup 21 is a widened portion of the strap 22. The material making up the chinstrap 22 may have some degree of rigidity so the widened area of the strap 22 forms the chin cup 21. Mesh materials may be inserted in the widened area for form the cup. Pliable plastic materials, such as neoprene plastics, known to those skilled in the art may also be used to fabricate the chin cup 21.

In the exemplary embodiment illustrated in FIGS. 5 through 7, the chin cup 21 may be composed of a foam material that is formed to take on a cup-like configuration. The chin cup 21 has an indentation 21A for receiving the chin of a user as shown in FIGS. 5 and 6. A foam material such as polyvinylnitrile may be used to fabricate the chin cup 21. The foam material is preferably encased within a tough pliable coating, preferably comprising a polyvinyl chloride. Known dipping or painting processes are used to apply the coating.

A fastening system for securing the chin cup 21 to the headgear 20, is attached to the free ends 34 and 35 of the chinstrap 22 and the bottom surface 32 of the chin cup 21 whereby the free ends 34 and 35 are connected to the headgear and detachably secured to the bottom surface 32 of the chin cup 21. Each side section 26 of circumferential member 23 has an aperture 40 through which a respective free end 34 or 35 is inserted. As shown in FIGS. 6 and 7, each free end 34 and 35 is folded around a bottom end of a respective side section 26 and then detachably fastened to a fastener on the chin cup 21. An alternative embodiment that may used with headgear having a hard outer shell may include a buckle attached to the headgear, wherein the buckle has an aperture through which free ends 34 and 35 are laced.

In the exemplary embodiment disclosed herein the fastening system includes one or more Velcro® sections, or other known hook/loop fasteners. The arrangement of the fastener sections as described herein is by way of example and is not intended to limit the scope of the invention. It is contemplated that the invention covers any combination of fastener sections by which the free ends 34 and 35 connect to the headgear and are detachably affixed to a fastener section on the bottom surface 32 of the chin cup 21, and/or to one another. Other fastening systems, such as snaps or buckles may be used.

Figure 8:
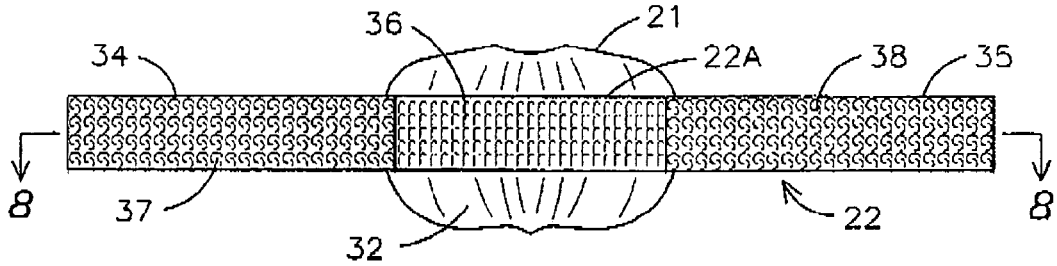
FIG. 8 is a bottom elevational view of the chinstrap with a chin cup.
Figure 9:
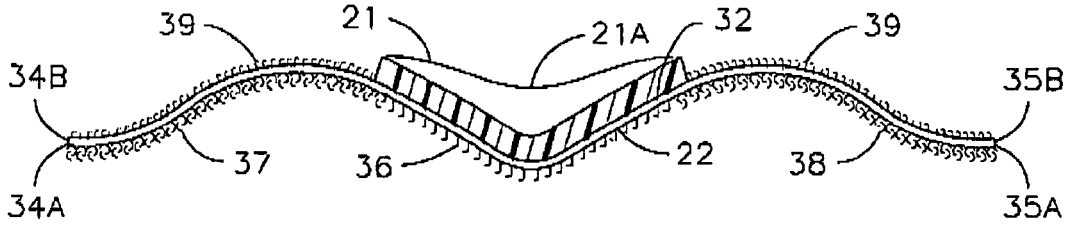
FIG. 9 is a sectional view of the chinstrap and chin cup taken along line 8—8 in FIG. 7.
Figure 10:
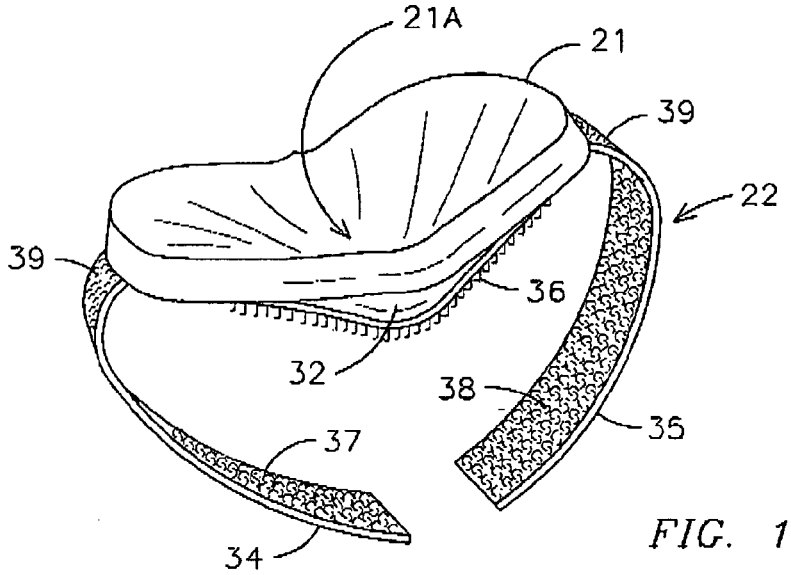
FIG. 10 is a perspective view of the chin cup with indentation for receiving a chin.

In the exemplary embodiment shown in FIGS. 8 through 10, the free ends 34 and 35 are integrally attached to a middle section 22A of the strap 22, which is affixed to a bottom surface 32 of the chin cup 21 forming a single strap. Respective free ends 34 and 35 extend laterally from the middle section 22A. Alternatively, the strap 22 may include free ends, 34 and 35, which are not integrally attached to the middle section 22A, but are affixed directly to the chin cup 21. The free ends 34 and 35 have respective first sides 34A and 35A and respective second sides 34B and 35B to which hook or loop components of the fastening system may be attached.

The hook and loop fastening system includes a hook component 36 affixed to the middle section 22A of the strap 22 and/or bottom surface 32 of the chin cup 21. A first loop component 37 is affixed to the first side 34A of free end 34, and a second loop component is 38 is affixed to a first side 35A of free end 35.

As shown in FIGS. 5 and 6, a user places the headgear 20 on his/her head and inserts free ends 34 and 35 through respective apertures 40 on the side sections 26 of the headgear 20. The free ends 34 and 35 are folded under respective bottom ends of the side sections 26 and the hook components 37 and 38 are detachably secured to the loop component 36 on the chin cup 22. In an exemplary embodiment, either or both of the free ends 34 and 35 may have a hook component 39 affixed to the second side 34B or 35B of the respective free ends 34 and 35. Such a hook component 39 is provided because the free ends 34 and 35 may overlap one another when the free ends 34 and 35 are secured to the chin cup 21. For example, the loop component 37 on the first side 34A of free end 34 may engage the hook component 36 on the chin cup 21, and the loop component 38 on the first side 35A of free end 35 may engage the hook component 39 on the second side 34B of free end 34.

In this manner a headgear with a chinstrap and chin cup is provided in which the chinstrap is adjustable, provides protection to the chin of a user and passes applicable testing standards for protective headgear.

While the preferred embodiments of the present invention have been shown and described herein, it will be obvious that such embodiments are provided by way of example only and not of limitation. Numerous variations, changes and substitutions will occur to those of skilled in the art without departing from the teaching of the present invention. Accordingly, it is intended that the invention be interpreted within the full spirit and scope of the appended claims.

We claim as our invention:

1. A protective headgear with a chin cup and chinstrap which are detachable from the headgear, comprising:

a circumferential member having a first side panel covering at least a portion of one side of a head and face of a user, a second side panel covering at least a portion of an opposite side of the head, a back panel covering at least a portion the back of the head and a top panel covering at least a portion of a top of the head;

a chin cup having an indentation for receiving a chin of the user;

a chinstrap having a first free end secured to the chin cup and extending laterally thereof, and a second free end secured to the chin cup and extend laterally thereof opposite the first free end;

a first aperture on the first side panel of the circumferential member through which the first free end is inserted, a second aperture on the second side panel of the circumferential member through which the second free end of the chinstrap is inserted, and the first free end and second free end of the chinstrap are detachably secured to the bottom of the chin cup; and wherein the circumferential member and the chin cup are composed of a resilient foam material and the apertures are formed in the side panels of the circumferential member, and the first free end and the second free end are folded under a bottom end of respective side panels and are detachably secured to the bottom surface of the chin cup.

2. The protective headgear of claim 1 wherein a hook and loop fastening system is affixed to the chinstrap and chin cup including a hook component affixed to a bottom surface of the chin pad and a first loop component affixed to the first free end of the chinstrap and a second loop component attached to the second free end of the chinstrap, and each of the first loop component and second loop component capable of engaging the hook component on the chin cup to detachably secure the chin cup to the headgear.

3. The protective headgear of claim 1 wherein a hook and loop fastening system is affixed to the chinstrap and chin cup including a loop component affixed to a bottom surface of the chin cup and a first hook component affixed to the first free end of the chinstrap and a second hook component attached to the second free end of the chinstrap, and each of the first hook component and second hook component is capable of engaging the loop component on the chin cup to detachably secure the chin cup to the headgear.

4. The protective headgear of claim 1 wherein the chinstrap includes a middle section affixed to a bottom surface of the chin cup and the first free end is integrally attached to the middle section and extends laterally from the middle section and the second free end is integrally attached to the middle section and extends laterally from the middle section and opposite the first free end, and a hook and loop fastening system is affixed to the chinstrap and chin cup including a hook component affixed to a bottom surface of the chin cup and a first loop component affixed to the first free end of the chinstrap and a second loop component attached to the second free end of the chinstrap, and each of the first loop component and second loop component capable of engaging the hook component on the chin cup to detachably secure the chin cup to the headgear.

5. A protective headgear with a chin cup and chinstrap, comprising:

a circumferential member composed of a resilient foam material and having a first side panel covering at least a portion of one side of a head and face of a user, a second side panel covering at least a portion of an opposite side of the head, a back panel covering at least a portion the back of the head and a top panel covering at least a portion of the top of the head;

a chin cup composed of a resilient foam material and having an indentation for receiving a chin;

a chinstrap having a middle section affixed to a bottom surface of the chin cup, a first free end of the chinstrap extending laterally from the middle section and a second free end of the strap extending laterally from the middle section of the chinstrap and opposite the first free end;

a first aperture formed in the first side panel of the circumferential member through which the first free end of the chinstrap is inserted;

a second aperture formed in the second side panel of the circumferential member through which the second free end of the chinstrap is inserted;

the first free end and second free end are folded under a bottom end of respective side panels of the circumferential member; and, a fastening system, operatively connected to the chinstrap, for detachably securing the first free end and the second free end of the chinstrap to the chin cup.

6. The protective headgear of claim 5 wherein the fastening system comprises a hook component affixed to a bottom surface of the chin cup and a first loop component affixed to the first free end of the chinstrap and a second loop component attached to the second free end of the chinstrap, and each of the first loop component and second loop component is capable of engaging the hook component on the chin cup to detachably secure the chin cup to the headgear.

7. A protective headgear with a chin cup and chinstrap, comprising:

a circumferential member composed of a resilient foam material and having a first side panel covering at least a portion of one side of a head and face of a user, a second side panel covering at least a portion of an opposite side of the head, a back panel covering at least a portion the back of the head and a top panel covering at least a portion of the top of the head;

a chin cup composed of a resilient foam material and having an indentation for receiving and engaging a chin;

a chinstrap having a middle section affixed to a bottom surface of the chin cup, a first free end of the chinstrap extending laterally from the middle section and a second free end of the strap extending laterally from the middle section of the chinstrap and opposite the first free end;

a first aperture formed in the first side panel of the circumferential member through which the first free end of the chinstrap is inserted;

a second aperture formed in the second side panel of the circumferential member through which the second free end of the chinstrap is inserted;

and the first free end and second free end are folded under a bottom end of respective side panels of the circumferential member; and, a fastening system, operatively connected to the chinstrap, for detachably securing the first free end and the second free end of the chinstrap to the chin cup wherein the fastening system comprises a hook component affixed to a bottom surface of the chin cup and a first loop component affixed to the first free end of the chinstrap and a second loop component attached to the second free end of the chinstrap, and each of the first loop component and second loop component capable of engaging the hook component on the chin cup to detachable secure the chin cup to the headgear.

8. A chin cup and chinstrap for a protective headgear having a first side panel for covering at least a portion of one side of the head of a user and a second side panel for covering an opposite side of the head and each side panel having an aperture formed therein, the chin cup and chinstrap comprising:

a chin cup composed of a resilient foam material encased within a pliable coating having an indentation for receiving and engaging a chin of a user;

a chinstrap having a first free end operatively connected to the chin cup and extending laterally from the chin cup, and a second free end operatively connected to the chin cup and extending laterally from the chin cup opposite the first free end, and each of the first free end and second free end capable of being inserted through an aperture on a respective side panel of the headgear; and, a fastening system, operatively connected to the chinstrap, for detachably securing the first free end and the second free end to a bottom of the chin cup after being inserted through the apertures on the headgear.

9. The chin cup and chinstrap of claim 8 wherein the fastening system comprises a hook component affixed to a bottom surface of the chin cup and a first loop component affixed to the first free end of the chinstrap and a second loop component attached to the second free end of the chinstrap, and each of the first loop component and second loop component capable of engaging the hook component on the chin cup to detachable secure the chin cup to the headgear.

10. The chin cup and chinstrap of claim 8 wherein the fastening system comprises a loop component affixed to a bottom surface of the chin cup and a first hook component affixed to the first free end of the chinstrap and a second hook component attached to the second free end of the chinstrap, and each of the first hook component and second hook component capable of engaging the loop component on the chin cup to detachably secure the chin cup to the headgear.

11. A chin cup and chinstrap for a protective headgear having a first side panel for protecting one side of the head of a user and a second side panel for protecting an opposite side of the head and each side panel having an aperture formed therein, the chin cup and chinstrap comprising:

a chin cup composed of a resilient foam material encased within a pliable coating having an indentation for receiving and engaging a chin of a user;

a chinstrap operatively connected to the chin cup having a first free end and a second free end extending laterally of the chin cup opposite one another;

a first free end and second free end capable of being inserted through the aperture on the respective side panels of the headgear;

a hook fastening component affixed to a bottom surface of the chin cup;

a first loop fastening component affixed to the first free end of the chinstrap positioned on the first free end of the chinstrap for engaging the hook fastening component on the chin cup and said first free end having been inserted through the aperture on a side panel of the headgear and extending to the chin cup; and, a second loop fastening component affixed to the second free end of the chinstrap positioned on the first free end of the chinstrap for engaging the hook fastening component on the chin cup and said second free end having been inserted through the aperture on a side panel of the headgear and extending to the chin cup.

12. The chin cup and chinstrap of claim 11 further comprising a second hook component on the first free end on a second side of the first fee end and the first loop component on the first free end engages the hook component on the chin cup, and wherein the second free end overlaps the first free end and the second loop component on the second free end engages the hook component on the first free end.

* * * * *